US008522794B2

(12) United States Patent
Boyle et al.

(10) Patent No.: US 8,522,794 B2
(45) Date of Patent: Sep. 3, 2013

(54) METHOD AND SYSTEM FOR IMPARTING STRAND EFFECT TO HAIR

(75) Inventors: Dennis Joseph Boyle, Palo Alto, CA (US); Natasha Jane Evans, Andover (GB); Betsy Charlotte Fields, Princeton, NJ (US); Simon Paul Godfrey, Uxbridge (GB); Mark Thomas Lund, Sunningdale (GB); Emily Joyce Ma, Atherton, CA (US); John Edward Sheppard, Wokingham (GB); John Wallace Smith, San Francisco, CA (US)

(73) Assignee: The Proctor & Gamble Company, Cincinnati, OH (US)

( * ) Notice: Subject to any disclaimer, the term of this patent is extended or adjusted under 35 U.S.C. 154(b) by 376 days.

(21) Appl. No.: 12/047,742

(22) Filed: Mar. 13, 2008

(65) Prior Publication Data

US 2008/0223393 A1 Sep. 18, 2008

Related U.S. Application Data

(60) Provisional application No. 60/906,641, filed on Mar. 13, 2007.

(51) Int. Cl.

| | |
|---|---|
| ***A45D 7/00*** | (2006.01) |
| ***A45D 7/04*** | (2006.01) |
| ***A45D 7/02*** | (2006.01) |
| ***A45D 24/34*** | (2006.01) |
| ***A61K 8/18*** | (2006.01) |
| ***A61Q 5/08*** | (2006.01) |
| ***A61B 1/00*** | (2006.01) |
| ***A61B 5/103*** | (2006.01) |
| ***A61B 5/117*** | (2006.01) |
| ***B43L 7/00*** | (2006.01) |
| ***G09B 19/10*** | (2006.01) |
| ***G09B 19/00*** | (2006.01) |
| *B65D 71/00* | (2006.01) |
| *B65D 69/00* | (2006.01) |
| *B65D 85/00* | (2006.01) |
| *A61Q 5/10* | (2006.01) |

(52) U.S. Cl.

USPC ..... 132/210; 132/207; 132/208; 132/212; 132/213; 33/512; 33/566; 434/94; 434/100; 206/232; 206/459.1

(58) Field of Classification Search

USPC ..... 132/210, 200, 202, 203, 207, 208, 132/270, 213, 214, 319, 148, 219, 212, 112, 132/333, 285, 320, 213.1, 221, 222; 434/94, 434/99, 100; 446/472; 206/581, 823, 569, 206/570, 232, 459.1, 459.5; 8/405; 33/512, 33/501.45, 562, 563, 566

See application file for complete search history.

(56) References Cited

U.S. PATENT DOCUMENTS

| | | | | |
|---|---|---|---|---|
| 337,224 | A * | 3/1886 | Albert | 33/562 |
| 2,221,774 | A * | 11/1940 | Bowser | 434/99 |

(Continued)

FOREIGN PATENT DOCUMENTS

| | | | |
|---|---|---|---|
| DE | 662702 | C1 | 7/1938 |
| DE | 197639177 | U1 | 4/1977 |

(Continued)

OTHER PUBLICATIONS

U.S. Appl. No. 12/581,476, filed Oct. 19, 2008, Glenn, Jr.

(Continued)

*Primary Examiner* — Vanitha Elgart

(74) *Attorney, Agent, or Firm* — James T. Fondriest; Carl J. Roof

(57) ABSTRACT

A method of imparting hair strand effects may include identifying each of a plurality of hair strands to which to apply a hair strand effect product independently and individually, the plurality of hair strands associated with an illustration of at least one type of hair strand effects and one of a plurality of hair styles, and applying the product to each of the plurality of hair strands independently and individually subsequent to identifying the plurality of hair strands. In the alternative or in combination, a hair instruction guide may be consulted, the guide having at least one strand size associated with one of the plurality of types of hair strand effects, and a strand of hair may be identified according to the at least one strand size. A system for creating a hair strand effect may include a hair strand effect product and such a hair instruction guide.

13 Claims, 13 Drawing Sheets

(56) References Cited

U.S. PATENT DOCUMENTS

| | | | | | |
|---|---|---|---|---|---|
| 2,272,409 | A | | 2/1942 | Johnson | |
| 2,310,295 | A | | 2/1943 | Keele | |
| 2,529,149 | A | * | 11/1950 | Fred | 132/213 |
| 2,776,667 | A | | 1/1957 | Fitzgerald | |
| 3,030,968 | A | | 2/1960 | Oberstar | |
| 2,930,385 | A | * | 3/1960 | Fees | 132/214 |
| 2,962,031 | A | | 11/1960 | Bumgarner | |
| 3,304,945 | A | * | 2/1967 | Anderson | 132/270 |
| 3,325,917 | A | * | 6/1967 | Kinnaman | 434/94 |
| 3,609,886 | A | * | 10/1971 | Vien | 34/99 |
| 3,662,767 | A | | 5/1972 | Murtha | |
| 3,702,508 | A | | 11/1972 | Netter | |
| 3,921,647 | A | | 11/1975 | Fisher | |
| 4,020,854 | A | | 5/1977 | Caruso | |
| 4,108,184 | A | | 8/1978 | Morganroth | |
| 4,144,897 | A | * | 3/1979 | Mosz | 132/270 |
| 4,206,772 | A | * | 6/1980 | Koepp | 132/226 |
| 4,398,549 | A | | 8/1983 | Thomas | |
| D276,661 | S | * | 12/1984 | Cafazzo | D28/20 |
| 4,503,870 | A | | 3/1985 | Peterson | |
| 4,619,280 | A | * | 10/1986 | Yampolskaya | 132/214 |
| 4,796,812 | A | | 1/1989 | Grollier | |
| 4,830,030 | A | * | 5/1989 | Busch et al. | 132/212 |
| 4,942,893 | A | | 7/1990 | Trottier | |
| 5,018,542 | A | * | 5/1991 | Lee | 132/139 |
| 5,042,514 | A | | 8/1991 | Bastien | |
| 5,060,679 | A | | 10/1991 | Christopher et al. | |
| 5,152,306 | A | * | 10/1992 | Stephan | 132/139 |
| 5,279,313 | A | | 1/1994 | Clausen | |
| 5,316,481 | A | * | 5/1994 | Louise et al. | 434/99 |
| 5,535,764 | A | | 7/1996 | Abramson | |
| 5,554,197 | A | | 9/1996 | Assini | |
| 5,609,484 | A | * | 3/1997 | Hawiuk | 434/94 |
| 5,771,906 | A | | 6/1998 | De Benedictis | |
| 5,779,479 | A | * | 7/1998 | Hawiuk | 434/94 |
| 5,823,204 | A | | 10/1998 | Todd | |
| 5,848,730 | A | | 12/1998 | Kawase | |
| 5,971,645 | A | | 10/1999 | Fukushima | |
| 6,062,231 | A | | 5/2000 | De LaForcade | |
| 6,148,829 | A | | 11/2000 | De Benedictis | |
| 6,240,928 | B1 | * | 6/2001 | DaSilva | 132/120 |
| 6,250,312 | B1 | | 6/2001 | Dasilva | |
| 6,427,701 | B1 | | 8/2002 | Roth | |
| 6,440,175 | B1 | | 8/2002 | Stanley | |
| 6,626,599 | B2 | | 9/2003 | De Laforcade | |
| 6,660,047 | B1 | * | 12/2003 | Stanley, III | 8/527 |
| 6,748,957 | B1 | | 6/2004 | Giordano | |
| 6,820,624 | B1 | * | 11/2004 | Palmeri | 132/200 |
| 6,835,018 | B2 | * | 12/2004 | Miczewski et al. | 401/196 |
| 7,000,619 | B2 | * | 2/2006 | Winckels et al. | 132/208 |
| 7,025,069 | B2 | | 4/2006 | Thiebaut | |
| 7,044,138 | B2 | * | 5/2006 | Brown | 132/139 |
| 7,156,102 | B2 | * | 1/2007 | Ramet | 132/160 |
| 7,198,049 | B2 | | 4/2007 | Elmer | |
| 7,232,466 | B2 | * | 6/2007 | Narasimhan et al. | 8/405 |
| 7,243,660 | B2 | * | 7/2007 | Capristo | 132/208 |
| 7,328,710 | B2 | * | 2/2008 | Hall et al. | 132/208 |
| 7,357,137 | B2 | | 4/2008 | Husband | |
| 7,407,055 | B2 | * | 8/2008 | Rodriguez | 206/581 |
| 7,425,220 | B2 | | 9/2008 | Barrass | |
| 7,475,688 | B2 | | 1/2009 | Colacioppo | |
| 7,543,591 | B1 | | 6/2009 | Munsil | |
| 7,597,106 | B2 | * | 10/2009 | Desmond et al. | 132/112 |
| 7,640,939 | B2 | | 1/2010 | Ploix | |
| 2002/0114657 | A1 | | 8/2002 | Gueret | |
| 2002/0142027 | A1 | | 10/2002 | Gueret | |
| 2002/0197228 | A1 | | 12/2002 | Lasala | |
| 2003/0007825 | A1 | | 1/2003 | De LaForcade | |
| 2004/0016064 | A1 | | 1/2004 | Vena | |
| 2004/0031502 | A1 | | 2/2004 | Winckels | |
| 2004/0089316 | A1 | | 5/2004 | Hamilton | |
| 2004/0182408 | A1 | | 9/2004 | De LaForcade | |
| 2005/0079192 | A1 | | 4/2005 | Simon | |
| 2005/0207153 | A1 | | 9/2005 | Leleve | |
| 2005/0211599 | A1 | | 9/2005 | De LaMettrie | |
| 2006/0042643 | A1 | | 3/2006 | Delan | |
| 2006/0064824 | A1 | | 3/2006 | Godfrey | |
| 2006/0090771 | A1 | | 5/2006 | Ramet | |
| 2006/0144415 | A1 | | 7/2006 | Magee | |
| 2006/0207036 | A1 | | 9/2006 | Kennedy | |
| 2007/0137669 | A1 | * | 6/2007 | Hamilton et al. | 132/208 |
| 2007/0144550 | A1 | | 6/2007 | Roher | |
| 2007/0215170 | A1 | | 9/2007 | Kennedy | |
| 2007/0227620 | A1 | | 10/2007 | Kunii | |
| 2008/0000492 | A1 | | 1/2008 | Mills | |
| 2008/0083418 | A1 | | 4/2008 | Glenn | |
| 2008/0083419 | A1 | | 4/2008 | Glenn | |
| 2008/0083420 | A1 | | 4/2008 | Glenn | |
| 2008/0087292 | A1 | | 4/2008 | Abergel | |
| 2008/0087293 | A1 | | 4/2008 | Glenn | |
| 2008/0087294 | A1 | | 4/2008 | Glenn | |
| 2008/0110929 | A1 | | 5/2008 | Stanley | |
| 2008/0156817 | A1 | | 7/2008 | Roseblade | |
| 2008/0196734 | A1 | | 8/2008 | Husband | |
| 2008/0223386 | A1 | | 9/2008 | Albisetti | |
| 2008/0223391 | A1 | | 9/2008 | Baker | |
| 2008/0223393 | A1 | | 9/2008 | Boyle | |
| 2008/0257370 | A1 | | 10/2008 | Perry | |
| 2008/0308119 | A1 | | 12/2008 | Smith | |
| 2009/0050171 | A1 | | 2/2009 | Barrass | |
| 2009/0071496 | A1 | | 3/2009 | Glenn | |
| 2009/0084393 | A1 | | 4/2009 | Baker | |
| 2009/0084394 | A1 | | 4/2009 | Baker | |
| 2009/0084395 | A1 | | 4/2009 | Glenn | |
| 2009/0095314 | A1 | | 4/2009 | Lund | |
| 2009/0101159 | A1 | | 4/2009 | Bonnafous | |
| 2009/0114238 | A1 | * | 5/2009 | Hornbach et al. | 132/210 |
| 2009/0152281 | A1 | | 6/2009 | Bowes | |
| 2009/0223531 | A1 | | 9/2009 | Lund | |

FOREIGN PATENT DOCUMENTS

| | | | |
|---|---|---|---|
| DE | 198805283 | U1 | 7/1988 |
| DE | 3138389 | C2 | 7/1990 |
| DE | 4041742 | A1 | 6/1992 |
| DE | 29616331 | U1 | 12/1996 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |
| EP | 1897459 | A1 | 3/2008 |
| EP | 1915920 | A1 | 4/2008 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 10290712 | A | 11/1998 |
| JP | 11-178630 | | 7/1999 |
| JP | 11-178639 | A | 7/1999 |
| JP | 2001-211925 | A | 8/2001 |
| JP | 2001523500 | A | 11/2001 |
| JP | 2002-034636 | A | 2/2002 |
| JP | 2003-199623 | A | 7/2003 |
| JP | 2003-310337 | A | 11/2003 |
| JP | 2004338725 | A | 12/2004 |
| JP | 2006043434 | A | 2/2006 |
| JP | 2006082852 | A | 3/2006 |
| JP | 3129205 | U | 2/2007 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

OTHER PUBLICATIONS

U.S. Appl. No. 12/622,716, filed Nov. 20, 2009, Smith.
U.S. Appl. No. 12/622,730, filed Nov. 20, 2009, Smith.
U.S. Appl. No. 12/622,762, filed Nov. 20, 2009, Smith.
U.S. Appl. No. 11/973,591, filed Oct. 9, 2007, Glenn Jr., et al.
U.S. Appl. No. 11/973,484, filed Oct. 9, 2007, Glenn Jr., et al.
U.S. Appl. No. 11/973,584, filed Oct. 9, 2007, Glenn Jr., et al.

* cited by examiner (Prior Art)

METHOD AND SYSTEM FOR IMPARTING STRAND EFFECT TO HAIR

CROSS REFERENCE TO RELATED APPLICATION

This application claims the benefit of U.S. Provisional Application No. 60/906,641, filed on Mar. 13, 2007.

FIELD OF THE INVENTION

The present disclosure generally relates to a method and system for imparting hair strand effects, and, more particularly, a method and system for applying a hair strand effect product.

BACKGROUND OF THE INVENTION

Conventional kits to alter the color, the light or the shape of hair typically include one or more compositions to impart hair strand effects and, optionally, an applicator tool. For temporarily altering hair shape, styling compositions may be used. A permanent hair shape effect may achieved by using perming compositions. Alterations to hair color may be fulfilled by a variety of compositions, such as direct dyes or oxidative dye pre-cursors. For highlighting effects, a composition having at least two components may be used: a liquid component containing an oxidant, preferably hydrogen peroxide, and a powder or paste component containing a further active substance, preferably a persulfate salt.

FIG. 1 illustrates one method 20 according to the prior art for creating highlighting effects. According to the method 20, the components of the highlighting composition are mixed at block 22. The composition may optionally be applied to an applicator at block 24, from which the composition is applied to the hair at block 26, or the composition may be applied to the hair using fingers at block 26. After waiting a predetermined amount of time at block 28, the composition may be rinsed from the hair at block 30.

While conventional kits used in carrying out the method of FIG. 1 may provide illustrations of the type of hair strand effects possible through use of the product, the accompanying instructions are devoted to the mechanics of use, rather than how to achieve a desired effect. The instructions typically will describe the technique necessary for combining the components and for applying the same in a safe manner. The instructions typically will not suggest how much composition should be applied in what fashion to achieve the hair strand effects illustrated or desired.

On the whole, the poor level of instruction may lead to inconsistent results and user dissatisfaction. Even if a user scrupulously follows the instructions in every detail, the user is left to trial and error to determine the amount and placement of the product necessary to provide a particular "look." As a result the user will often apply product to the wrong hair strands, and apply the product to hair strands of an inappropriate width. Such an application produces an unexpected hair appearance. While trial and error may be acceptable, even desirable, in regard to clothing and accessories, few people would consider trial and error an acceptable strategy when it comes to hair color and highlighting due to the permanence of the color result. Most consumers would prefer predictable results.

In the alternative to the kits described relative to FIG. 1, users may use a "cap and hook" system to produce hair strand effects at home. A method 40 describing the use of such a system is illustrated in FIG. 2. At block 42, the user places the cap on top of the head of hair to be treated. The cap has predefined holes spaced across its surface. After the user places the cap onto the hair, the user pulls hair strands through the holes, using the hook, at block 44. Then, at block 46, the user mixes the composition, similar to block 22 in FIG. 1. The product is applied all over the cap at block 48. The user then waits the predetermined amount of time at block 50, and removes the product at block 52, and removes cap at block 54.

Here again, the system and the method have their drawbacks. First, the process of pulling the hair strands through the holes in the cap may be painful. Second, the user's choices as to the location of the hair stands to be treated are limited. Third, the process of pulling the hair through the holes can lead to unexpected results, because the hair pulled through the hole does not necessarily come from the scalp directly below the hole. For example, the hair strand effects may be imparted to hair strands at an undetermined distance from their respective roots.

Accordingly, it would be desirable to provide a method and system that demystified the process of imparting hair strand effects. Additionally, it would be desirable to provide a method and system with a strategy that produced reproducible results, such that the user could apply the hair strand effect product with confidence that adherence to the instructions should provide a desired outcome.

SUMMARY OF THE INVENTION

In one aspect, a method of imparting hair strand effects to hair includes identifying each of a plurality of hair strands to which to apply a hair strand effect product independently and individually, the plurality of hair strands associated with an illustration of at least one type of hair strand effects and one of a plurality of hair styles associated with each of the at least one type of hair strand effects. The method also includes applying the product to each of the plurality of hair strands independently and individually, subsequent to identifying the plurality of hair strands to which to apply the product. The method may optionally include waiting a predetermined length of time and removing the product from each of the plurality of hair strands.

In another aspect, a method of imparting hair strand effects to hair includes selecting a type of hair strand effect from a plurality of types of hair strand effects, optionally consulting a hair instruction guide, the hair instruction guide including at least one strand size, the at least one strand size associated with one of the plurality of types of highlighting effects, identifying a strand of hair according to the at least one strand size, and applying product to the strand. The method may optionally include waiting a predetermined length of time and removing the product from the strand.

In a further aspect, a system for imparting hair strand effects to hair includes a hair strand effect product and a hair instruction guide. The hair instruction guide has at least two portions, a first portion including a hair strand sizer and a second portion including an illustration of a type of hair strand effect produced if the hair strand effect product is applied to a strand of hair similar to the hair strand sizer.

Additional aspects of the disclosure are defined by the claims of this patent.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. None of the drawings are necessarily to scale, unless particularly noted as such.

DETAILED DESCRIPTION OF THE INVENTION

The following embodiments are directed to a method and a system of imparting highlighting effects to hair as an exemplary embodiment of the method and system of imparting hair strand effects to hair according to the present disclosure. Those skilled in the art will recognize that methods and systems for hair dyeing, hair perming and hair styling are also embraced within the scope of the present disclosure. Thus, all such methods and systems, as well as even further methods and systems for altering the shape, color and lightness of hair not disclosed herein, would be embraced by the term "hair strand effect methods and systems."

Figure 15A:
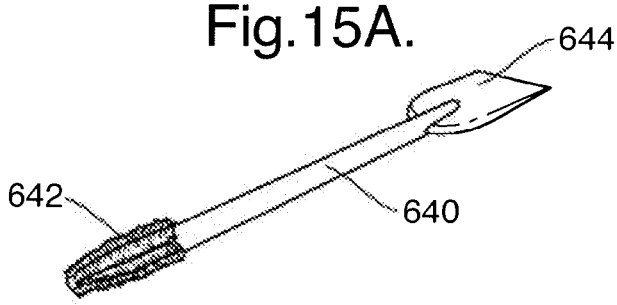
FIGS. 15A and 15B are perspective views of embodiments of a wand-type applicator.
Figure 15B:
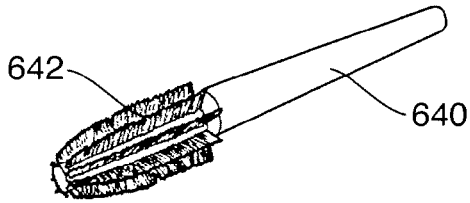
Figure 16:
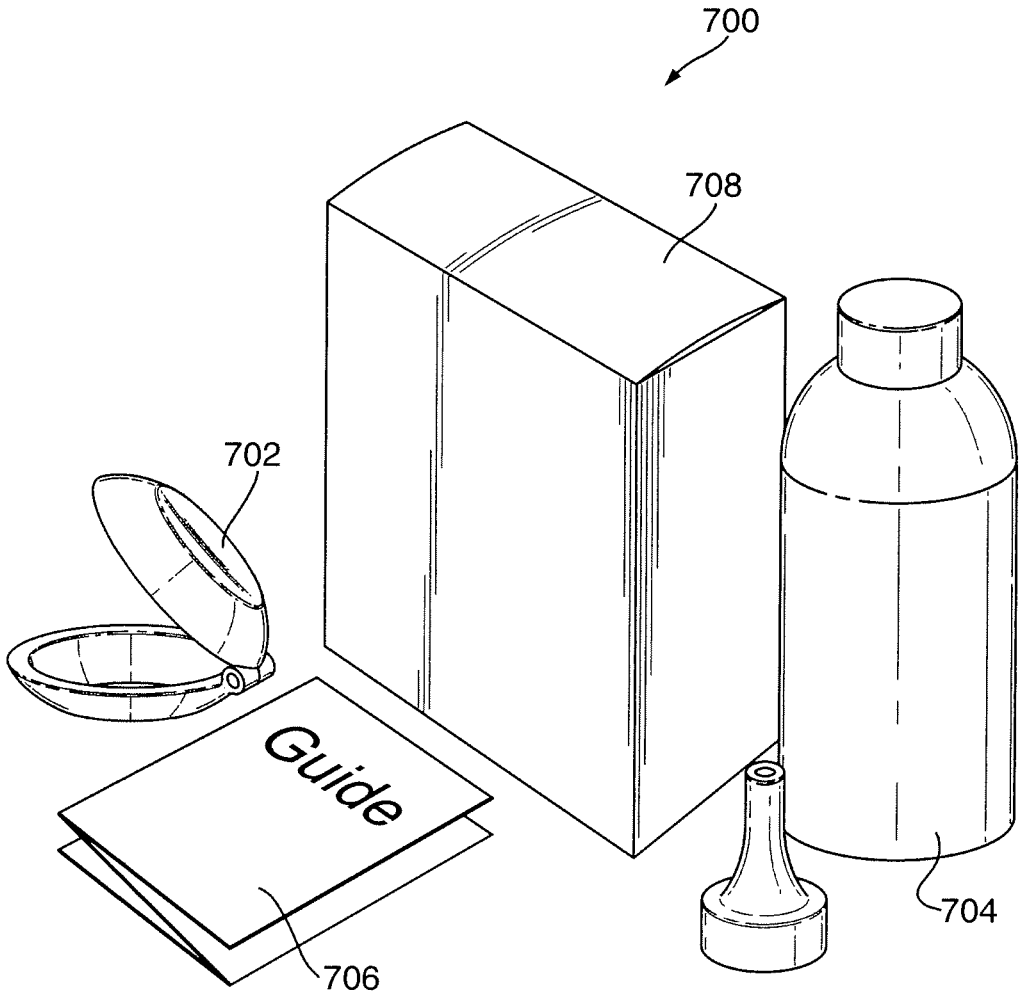
FIG. 16 is a schematic view of a system for imparting hair strand effects according to the present disclosure.

Thus, FIGS. 3A-5 illustrate various methods for highlighting hair, which may be used with guides illustrated in FIGS. 6-10 and applicators illustrated in FIGS. 11-15, which may collectively define the system illustrated in FIG. 16. It will be recognized that various combinations of methods, guides, applicators, and systems are possible, such that it would be impractical to attempt to discuss every such combination. Likewise, it will be recognized that additional embodiments of methods, guides applicators, and systems are possible, such that it would be impractical, if not impossible, to attempt to discuss every such embodiment. The following is a discussion of the exemplary combinations and embodiments illustrated.

Figure 1:
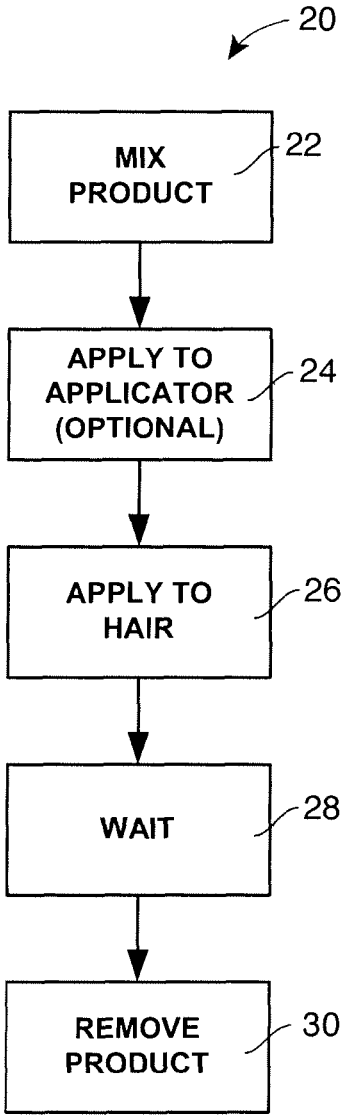
FIG. 1 is a flowchart illustrating an embodiment of a prior art method of highlighting hair.
Figure 2:
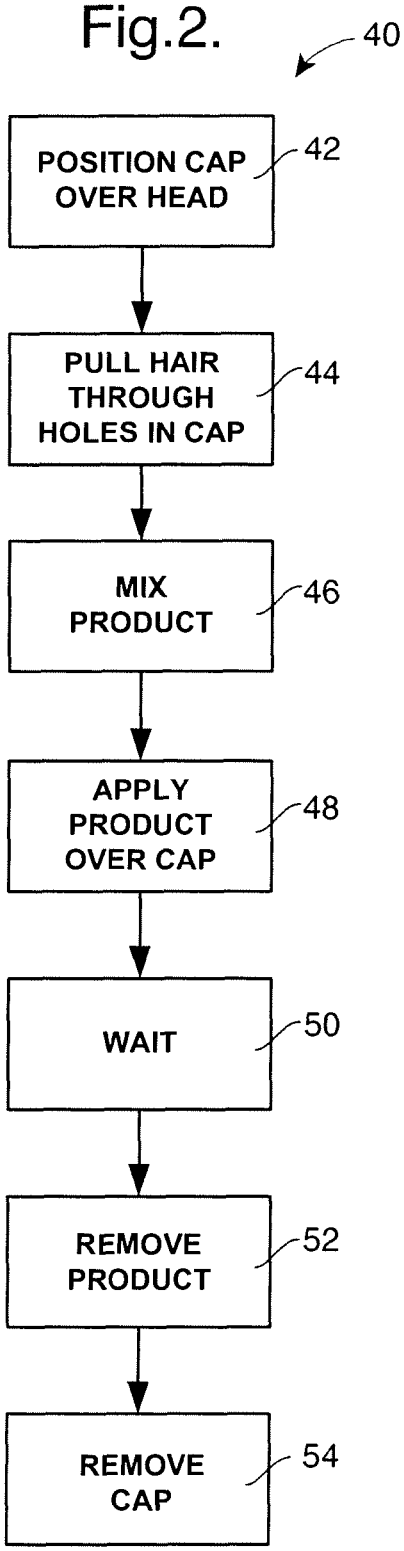
(Prior Art) Fig.2.
FIG. 2 is a flowchart illustrating an embodiment of a prior art method of highlighting hair using a "cap and hook" system.
Figure 3A:
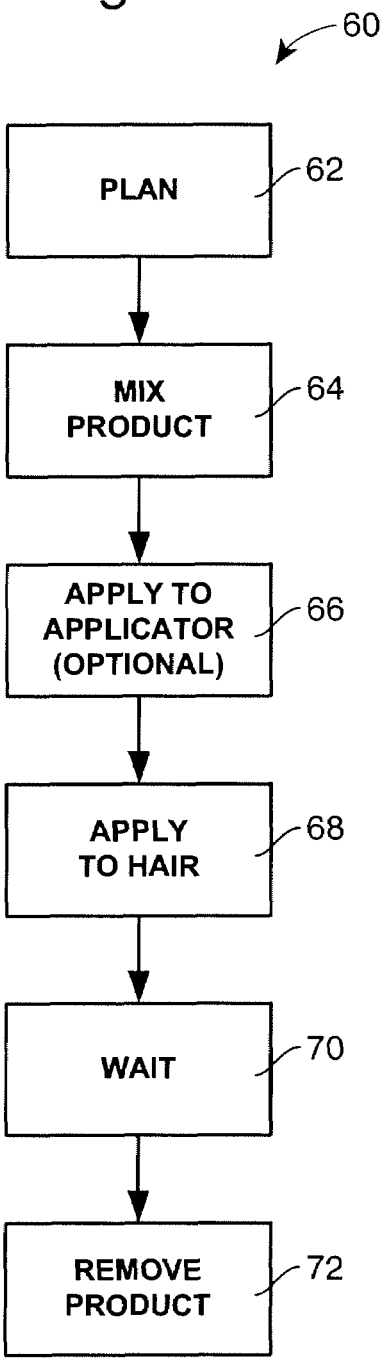
FIG. 3A is a flowchart illustrating an embodiment of a method of imparting hair strand effects according to the present disclosure.

FIG. 3A illustrates, in general terms, a method 60 of imparting highlighting effects to hair according to the present disclosure. At the very outset, at block 62, the user plans the application of the highlighting product. Quite obviously, the user may mix the product before planning the placement of the highlighting product on the hair strands, but the planning step certainly is conducted prior to application. Moreover, the planning step preferably occurs before even the mixing step. The planning step is explained in greater detail below. After completing the planning step, the method 60 may proceed to block 64, where the highlighting product is mixed. Optionally, the highlighting product may be applied to an applicator at a block 66, the applicator being any of those illustrated in FIGS. 11-15, and the product applied from the applicator, or through the use of one's own fingers, at block 68 to the hair, which application is performed individually and independently. After the product is applied, it may be necessary to wait a predetermined length of time for the product to work, as indicated at block 70. Once the desired level of lightening has occurred, the product may be removed at block 72, by rinsing off the product, for example. It will be recognized that the steps of blocks 70, 72 may be optional depending on, for example, the hair strand effect product used and the type of hair strand effect being imparted.

Figure 3B:
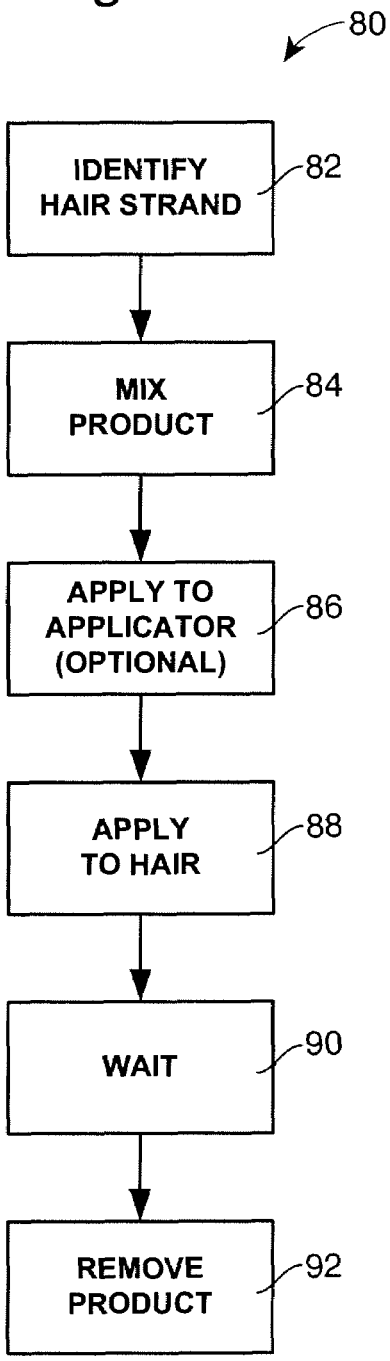
FIG. 3B is a flowchart illustrating an alternative expression of the method of imparting hair strand effects according to FIG. 3A.

FIG. 3B illustrates, in more specific terms, a method 80 of imparting highlighting effects to hair according to the present disclosure. The method 80 begins at block 82 with the identification of each of a plurality of hair strands to which to apply a highlighting product. The identification of hair strand is performed independently and individually, and may be performed with reference to a hair instruction guide, such as is illustrated in FIGS. 6-10. After completing this step, the method 80 may proceed to block 84, where the highlighting product is mixed. Optionally, the highlighting product may be applied to an applicator at block 86, and then to the hair at a block 88, the application of the hair also being performed individually and independently. After the product is applied, the user may wait at block 90. At block 92, the product may be removed. Again, it should be noted that blocks 90, 92 may be optional according to certain alternative embodiments.

It is believed that it is important that the planning, in particular the identification of each of the plurality of hair strands to be treated, be performed before continuing on to the remainder of the method. As explained above, conventional highlighting methods and kits traditionally do not require a planning step that occurs before subsequent steps of applying, waiting and rinsing. It is further believed that, as a consequence of failing to plan before applying the product, the product may be applied to hair strands that are either too close together or too far apart, or simply in the wrong areas, resulting in an effect that may be considerably different than the desired effect.

It also should be noted that the identification of each of the plurality of hair strands and the application of the plurality of hair strands is to be performed independently and individually. That is, in identifying each of the plurality of strands independently and individually, while the user may address each strand relative to the head as a whole in terms of location, the user identifies each of the hair strands one-by-one. This may be done by separating the hair strand using one's fingers or a comb end, for example, or simply by the user looking at their hair and visualizing the locations of the hair stands around their head. In the same fashion, in applying the product to each of the plurality of hair strands independent and individually, the user applies the product to each of the hair strands one-by-one. This may be done by using an applicator or the user's fingers and by applying the product only to the strand of interest in isolation, for example. It is believed that the identification and application to each strand independently and individually may produce a more controlled and tailored result.

This independent and individual identification and application may be contrasted with, for example, conventional methods that use a cap and hook system. In such a system, the cap has a plurality of predetermined hair strand locations defined by holes that may be formed by removing sections of the cap. With the holes removed, the cap is applied to the head of the user, and a hook is used to pull sections of the hair through the holes. This is a painful process. Further the hair pulled through does not always correspond to the hair which grows directly below the hole. In this fashion, the hair strands are identified as a collective group by virtue of the open regions of the cap, and not on a one-by-one basis. Moreover, the product is then applied to all of the hair strands depending from the holes in the cap by applying the product over the surface of the cap. In this fashion, application is also performed on a collective basis. It is believed that the results of this product are less than satisfactory, as the cap not only prevents the product from contacting those hair strands not initially identified, but the cap prevents visualization of the location and placement of the hair strands, which may have an adverse impact on the results.

Figure 4A:
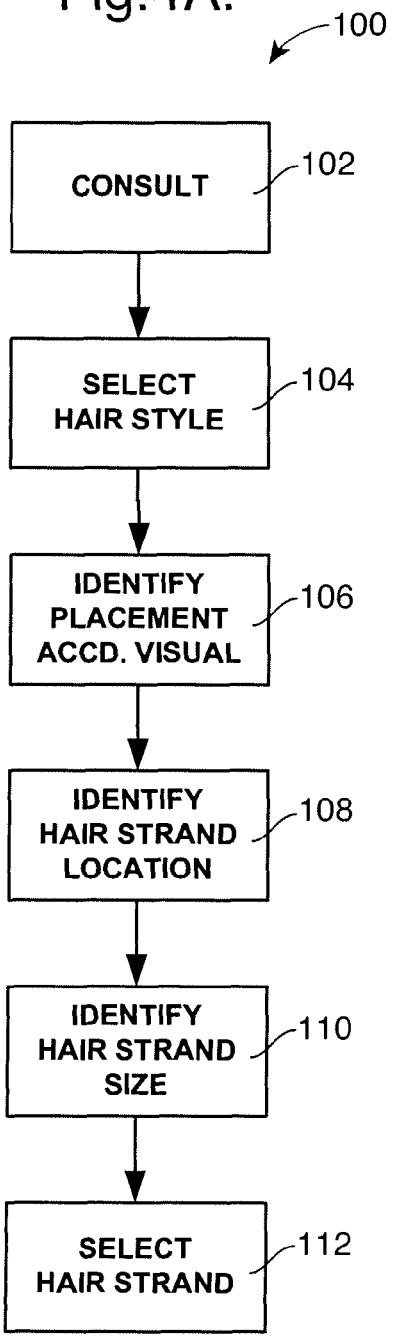
FIG. 4A is a flowchart illustrating, in greater detail, a method of identifying hair strands as included in the method of embodiment of FIG. 3B.

It will be recognized that the identification of the hair strands identified with block 82 of the method 80 may actually be the combination of several interrelated activities, not all of which must be present in each embodiment for the user to complete the step of identifying the hair strands as represented in the block 82. FIG. 4A illustrates one possible embodiment of a method 100 of performing the step of identifying the hair strands.

The method 100 begins at block 102 with consultation of a hair instruction guide, exemplary embodiments of which are illustrated in FIGS. 6-9 and 10. For example, each of FIGS. 6-9 may represent a separate page of a multi-page hair instruction guide. Alternatively, each of FIGS. 6-9 may represent a separate panel or section of a single-sheet, multi-panel or multi-section hair instruction guide. The guide may be separate and apart from packaging used in conjunction with systems or kits, as explained in greater detail below with reference to FIG. 16, or the guide may be printed on the packaging that is used. Further, as explained in greater detail below, the hair sizer of FIG. 10 may be used in conjunction with the illustrations of FIGS. 6-9 in the alternative to the integrated presentation of FIGS. 6-9.

Turning first to FIGS. 6-9, each page or panel 200 of FIGS. 6-9 has at least two portions 202, 204. The first portion 202 includes a hair strand sizer 206, which will be discussed in greater detail, below. The second portion 204 includes an illustration 208 of a type of highlighting effect. As will be recognized with reference to FIGS. 6-9, each page or panel 200 illustrates a different type of highlighting effect selected from a plurality of highlighting effects (as illustrated, four types of highlighting effects). It will also be recognized that a hair instruction guide may include a single page or panel 200, for example, that shown in FIG. 6.

In addition, each illustration 208 for each of the types of highlighting effects includes an image 210 of at least one hair style, the image 210 showing the locations 212 of a plurality of hair strands about a head 214 associated with the type of highlighting effect for that hair style 210. As shown, each illustration 208 for each of the types of highlighting effects includes a plurality of images 210 (as illustrated, four images representing four hair styles). Where several images 210 are presented, each image 210 associated with a different hair style, the user may select and use the image 210 of the hair style closest to their own hair style. In the alternative, it will be recognized that an illustration 208 may include a single image 210.

Thus, returning to FIG. 4A, in those embodiments where the hair instruction guide includes more than one type of highlighting effect or more than one type of hair style, the method may proceed to block 104, where the user selects a type of highlighting effect and, according to certain embodiments, a type of hair style from among the plurality of types of highlighting effects and styles shown. According to other embodiments, where only one type of highlighting effect and/or style is included, all or part of this step may be optional. Once the type of highlighting effect is selected as block 104 (if required), the identification of the hair strands may be performed according to the visual representations provided, such as the illustration 208, at block 106. At block 108, the user may identify locations of each of the hair strands about the head to produce the highlighting effect.

The hair guide may provide more than information in regard to the location of the hair strands associated with a type of highlighting effect, however. The hair guide may also provide information on the width of the hair strand appropriate to provide the type of highlighting effect selected. Thus, the method 100 may proceed to block 110, wherein the user may identify the size of the hair strand associated with the type of highlighting effect selected. This information may be provided in the first portion 202 of the page or panel 200. This information may include a reference to the width of the strand in units of measurement, such as SI or English units. However, and perhaps more importantly, the first portion 202 may include the hair strand sizer 206.

The hair strand sizer 206 is a to-scale illustration of the width of the hair strand associated with a particular type of hair strand effect, where widths may vary between effects (as illustrated), and even between styles. Thus, rather than simply suggesting a width in terms of a measurement, which may be difficult for the user to appropriately visualize, the sizer 206 includes a representation of the width in a to-scale illustration. While the illustration as shown is in the form of a pair of parallel lines with arrows disposed to the left and the right of the lines, it will be recognized that any number of different illustrations may be used to convey the same informational content visually, FIG. 10A for example. As another alternative, the sizer may be defined on an edge of the guide, and a slot may be formed in the edge of the guide, the distance between the sides of the slot corresponding to the desired width of the hair strand. When users refer to the to-scale illustration, it is believed that they may moderate the width of the hair stands they select leading to more desirable end result comparable with their chosen highlight effect. The sizer 206 may include text as well; for example, the sizer 206 may include the statement "Choose a strand approximately this wide at the roots."

Figure 10:
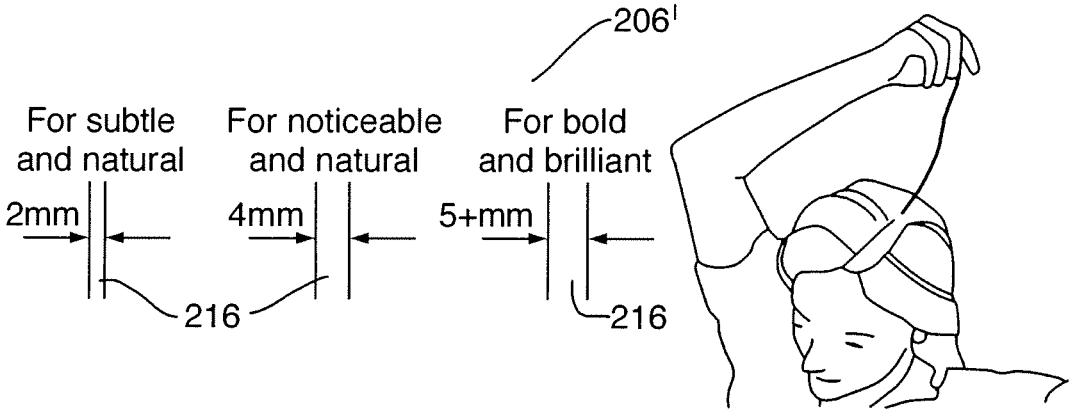
FIG. 10 is an illustration of a portion of an alternative hair instruction guide.
Figure 10A:
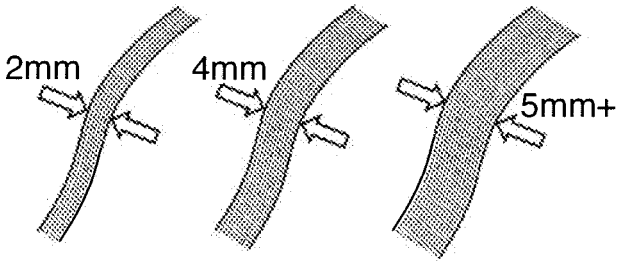
FIG. 10A is an illustration of an alternative embodiment of a hair strand sizer according to the present disclosure.

As illustrated in FIG. 10, the hair strand sizer 206 may be included as an item separate and apart from the illustrations 208. The sizer 206' includes illustrations 216 for the widths of hair strands associated with several different types of highlighting effects. The widths of the sizer 206' may be different for each type of hair strand effect, as illustrated (similar to FIGS. 7-9, above); alternatively, the widths may be similar or the same for different hair strand effects (compare FIGS. 6 and 8, above) The widths may even vary according to hair styles. The sizer 206' is not integrated with the illustrations 208 shown in the hair guide of FIGS. 6-9. According to such an embodiment, the illustrations 208 may be provided on pages or panels 200 in a guide similar to the guide illustrated in FIGS. 6-9, which portion may thus be used in combination with the sizer 206'. It is also possible, however, that a sizer 206' may be used in conjunction even with the guide shown in FIGS. 6-9 wherein the panels each include a sizer 206. That is, for purposes of ease of use, it may be convenient that a hair instruction guide include both a sizer 206 associated and integrated with each page or panel 200 of the guide including the illustration 208, and a sizer 206' that is separated from the page or panel 200 on which the illustration 208 is displayed. If the sizer 206' is separate from the other portion of the guide, the sizer 206' may be made of materials that permit the sizer 206' to be disposable or to be reusable.

Having thus identified the location and size of the hair strands in blocks 108, 110, the method proceeds to block 112, wherein the hair strands are selected by the user. As mentioned previously above, the activity may be undertaken by the user with their fingers or a tool, such as a comb end. Moreover, the selection of the hair strands may be temporarily secured through the use of a hair strand selection means attached to the base or root of the hair strand. Many types of hair strand selection mechanisms or means can be used, including clips, such as those conventionally used for hair care, may be used, such clips have opposing ends biased towards each other by a spring for example. Preferably clips which have a predetermined size in order to assist the user to preselect the appropriate size for the desired end result are used. With the hair strands thus secured, the method may proceed to the steps of mixing, application, waiting and removal illustrated by blocks 86-92 in FIG. 3B.

Figure 4B:
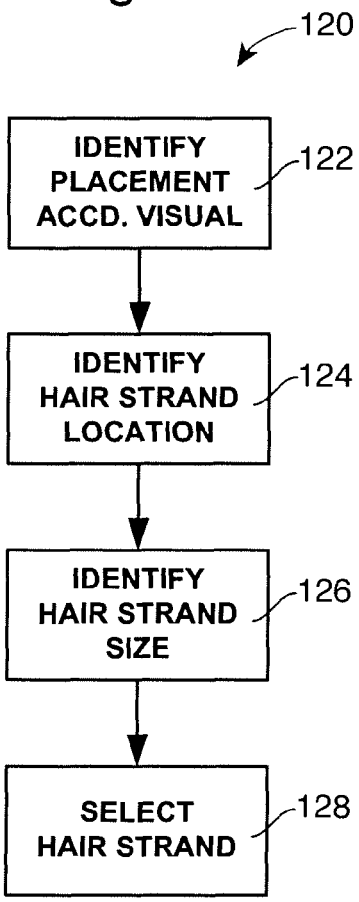
FIG. 4B is a flowchart illustrating, in greater detail, an alternative method of identifying hair strands as included in the method of embodiment of FIG. 3B.
Figure 4C:
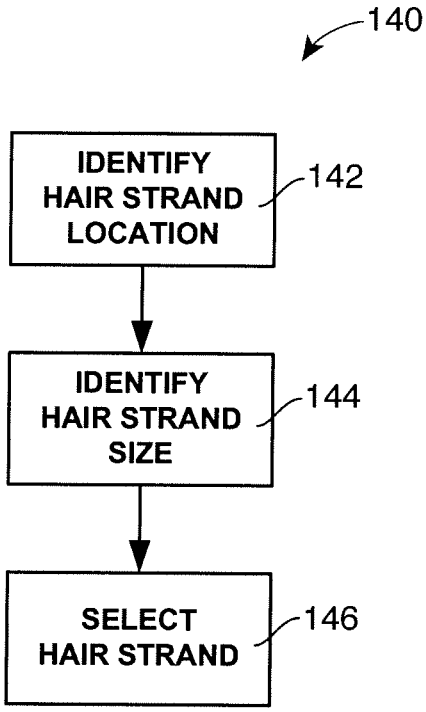
FIG. 4C is a flowchart illustrating, in greater detail, a further alternative method of identifying hair strands as included in the method of embodiment of FIG. 3B.

It will be recognized that not all of the steps illustrated in the flowchart of FIG. 4A need necessarily be carried out according to all embodiments of the disclosed method. For example, FIGS. 4B and 4C illustrate alternative methods 120, 140 to the method 100 illustrated in FIG. 4A. For instance, in the method 120 of FIG. 4B, the user may perform the steps of identifying the placement of the product at block 122, identifying the location of the hair strands at block 124, identifying the size of the hair strands at block 126 and selecting the hair strands at block 128. In the method 140 of FIG. 4C, the user may perform the steps of identifying the location of the hair strands at block 142, identifying the size of the hair strands at block 144 and selecting the hair strands at block 146. These methods 120, 140 are also embraced by the present disclosure.

Figure 5:
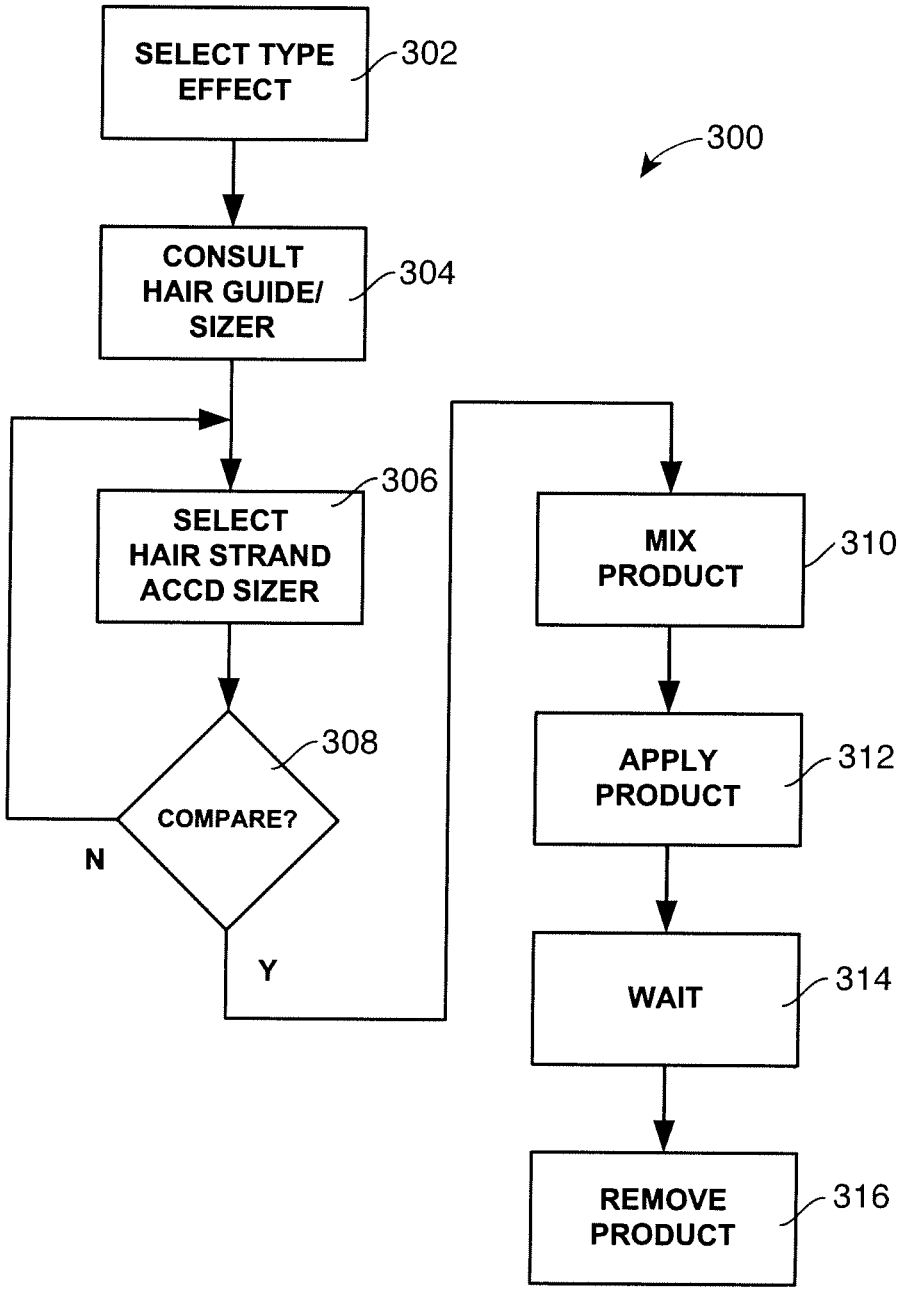
FIG. 5 is a flowchart illustrating an embodiment of a further method of imparting hair strand effects according to the present disclosure, which method may be in substitution for or in combination with the method of FIGS. 3A and 3B.
Figure 6:
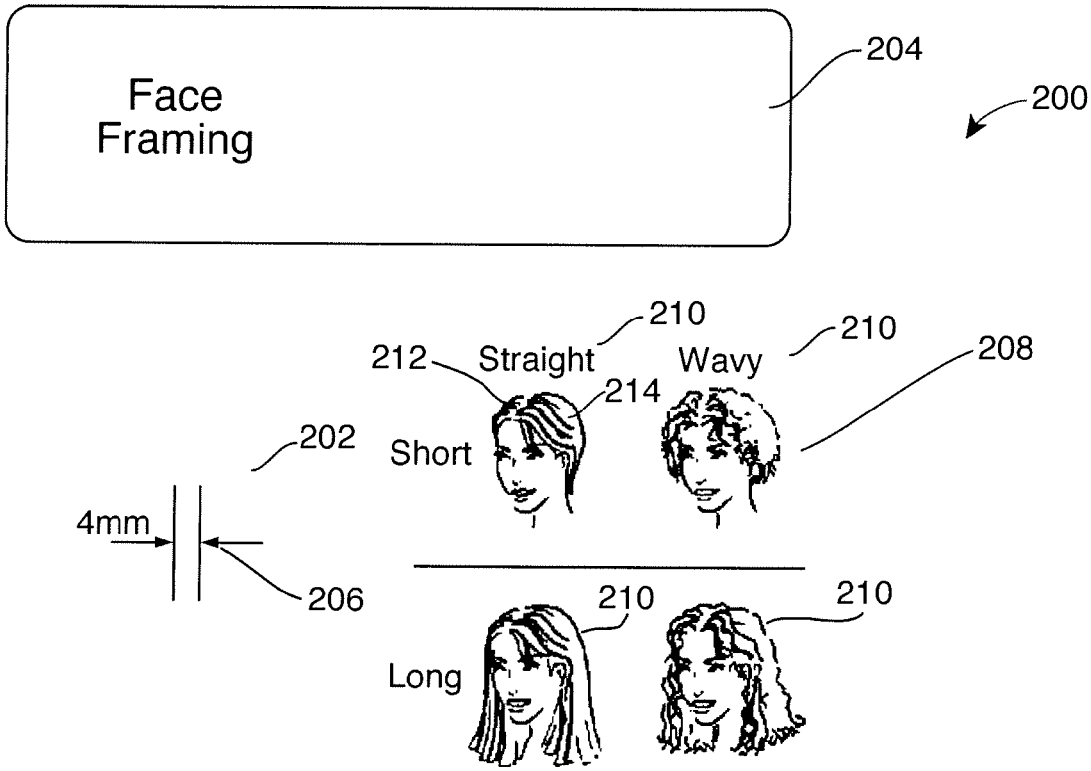
FIG. 6 is an illustration of a page or panel of a hair instruction guide according to the present disclosure for use with the methods illustrated in FIGS. 3A-5.
Figure 7:
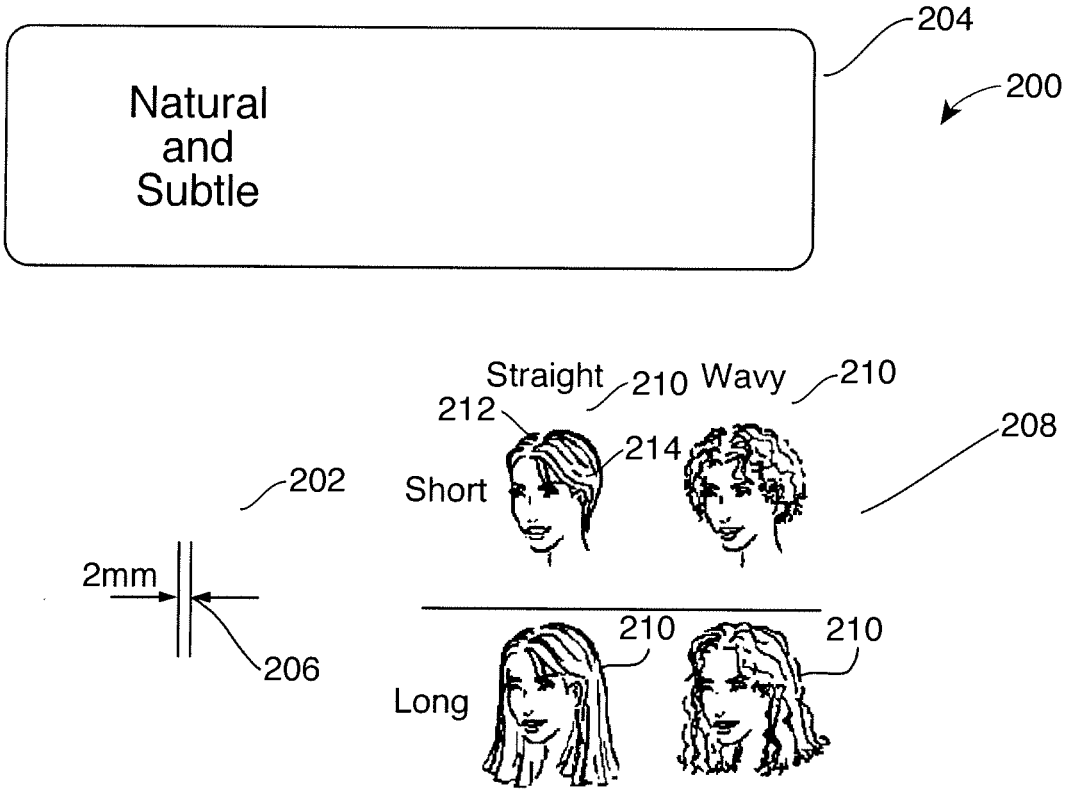
FIG. 7 is an illustration of a second page or panel of the hair instruction guide according to FIG. 6.
Figure 8:
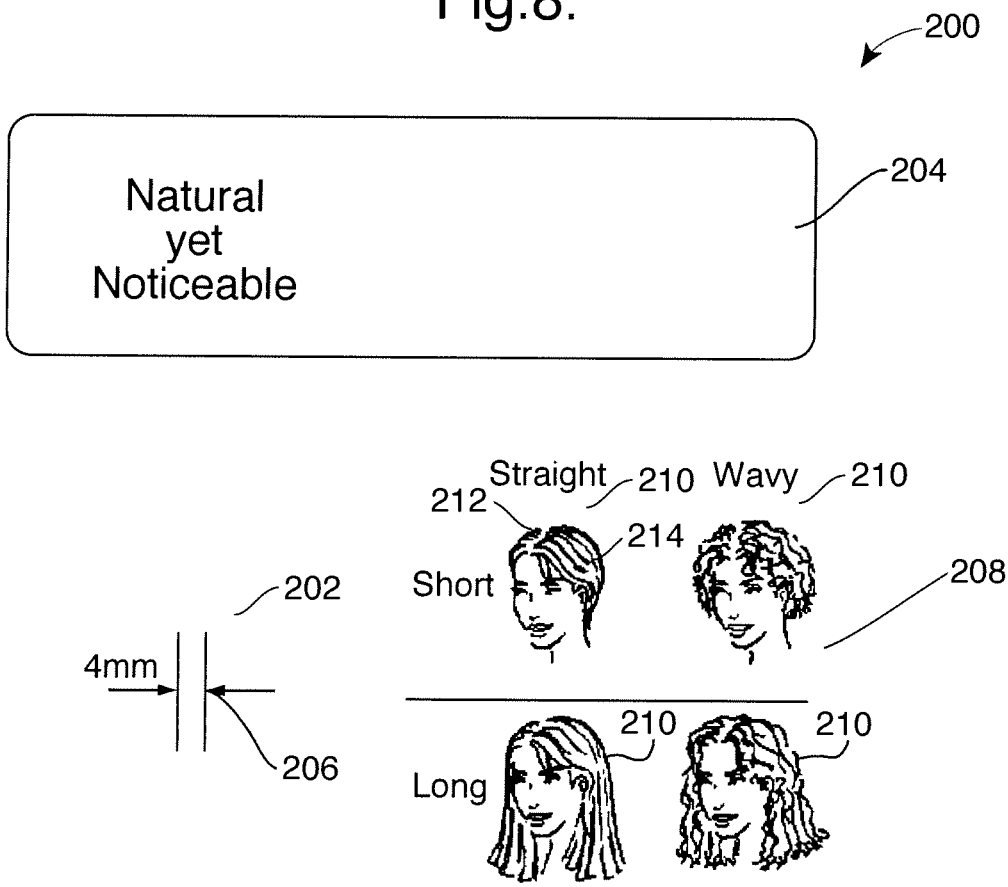
FIG. 8 is an illustration of a third page or panel of the hair instruction guide according to FIG. 6.
Figure 9:
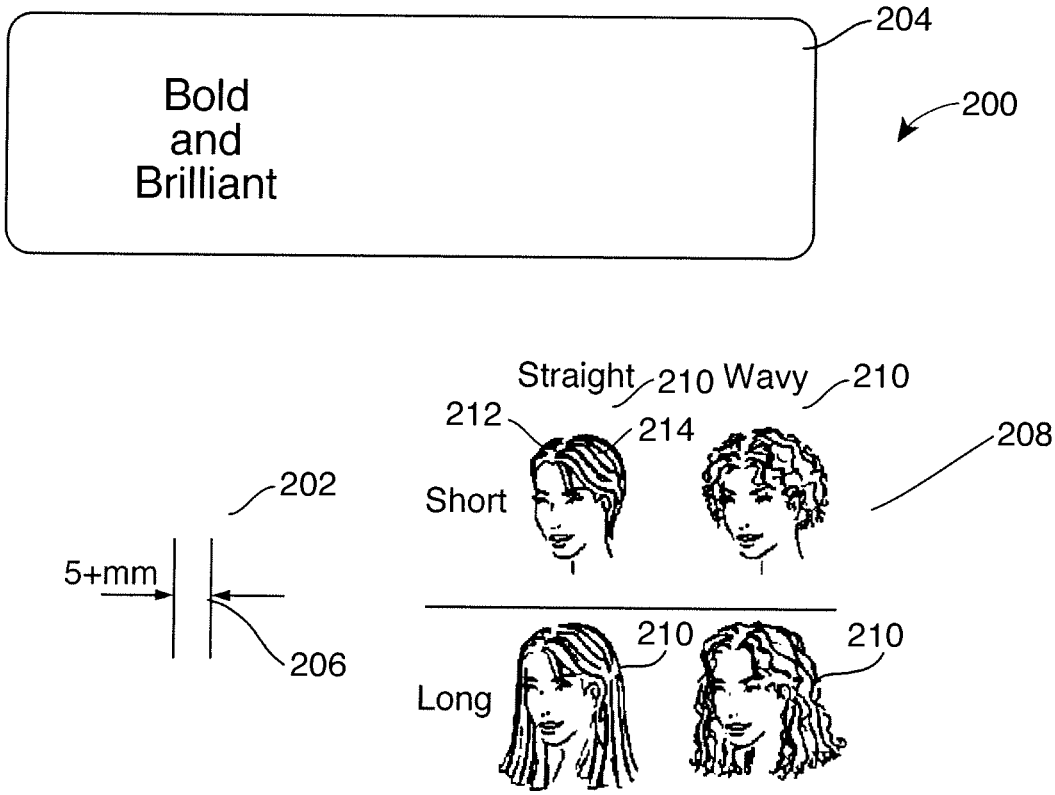
FIG. 9 is an illustration of a fourth page or panel of the hair instruction guide according to FIG. 6.

Further, it will be recognized that aspects of the method 100 may in and of themselves represent an improvement over conventional highlighting methods. For example, FIG. 5 illustrates the aspect of the method previously discussed wherein the sizer 206 is used to identify and select the hair strand size. The method 300 illustrated in FIG. 5 may begin at block 302 with selection of the type of highlight effect in those embodiments wherein more than one type of highlight effect is provided. After the type of highlight effect is selected at block 302, the method 300 continues on to block 304, wherein the sizer 206, 206' is consulted in identifying the size of hair strand associated with the type of highlighting effect selected. As noted above, the sizer 206 may be integrated with the other portions (illustration 208, for example) that make up the hair guide, or may be formed or defined separately, as the sizer 206' illustrated in FIG. 10.

Once the size of the hair strand size is identified, the method 300 may proceed to block 306, wherein the hair strand is selected according to the size associated with the type of highlighting effect selected. After the selection, the strand selected may be compared with the sizer 206 at block 308 to determine if the width of the hair strand selected is similar to the width of the hair strand illustrated on the sizer 206, 206'. According to certain embodiments, the user may attempt to determine if the hair strand is the same as that illustrated, i.e., if the hair strand selected matches the hair strands associated with the type of highlighting effect selected according to the hair sizer 206, 206'. However, as a general matter, the user probably will not produce an exact match to the width of the illustration on the sizer, and that is acceptable according to the method and system of the present disclosure. It is sufficient that the sizer enables the user to select a width of hair strand which is closer to that required to produce their desired hair strand effect style than if the sizer was not included.

As illustrated, according to the comparison, the method 300 may return to block 306 and another strand may be selected. It will be recognized that the process 300 may iterate repeatedly until a strand is selected that is sufficiently similar to the width of the hair strand associated with the type of effect selected. For that matter, it will also be recognized that the activities of blocks 306, 308 may be repeated for each of the hair strands selected. Alternatively, only the first strand may be compared against the sizer 206, 206', the activity of block 308 thus being optional in all but the first iteration. Other embodiments are possible wherein only a certain number of strands are compared to determine if they match the width illustrated on the sizer 206, 206' associated with the type of highlighting effect selected. The comparison may even be performed on a random basis. Further, the comparison may be omitted entirely, with a visual inspection being performed initially to fix in the mind of the user the size of hair strand to be identified and selected.

With the activities of blocks 302-308 thus performed, the method 300 continues on to block 310, wherein the product is mixed, and block 312, wherein the product is applied. The user then waits at block 314 until the predetermined time elapses, and then removes the product at block 316, by rinsing the product off, for example. According to alternative embodiments, the actions taken at blocks 314, 316 may be optional.

Having thus discussed the methods of FIGS. 3A-4C relative to the guides of FIGS. 6-10, reference is now made to the plurality of applicators illustrated in FIGS. 11-15. It will be recognized that the methods and guides discussed above may be used with any number of different applicators, of which only exemplary embodiments are illustrated. No limitation is meant through the illustration of those applicators shown in FIGS. 11-15. However, the applicators of FIGS. 11-15 are provided to indicate the wide range of application tools that might be used.

The applicators illustrated in FIGS. 11-15 may be discussed as belonging to several different classes. The applicator illustrated in FIGS. 11 and 12 may be referred to as a hinged applicator. The applicators illustrated in FIGS. 13A and 13B are different embodiments of a brush-type applicator, while the applicators illustrated in FIGS. 14A-14D are different embodiments of a comb-type applicator. The applicators illustrated in FIGS. 15A and 15B are embodiments of a wand applicator, such an applicator resembles a conventional mascara brush.

Figure 11:
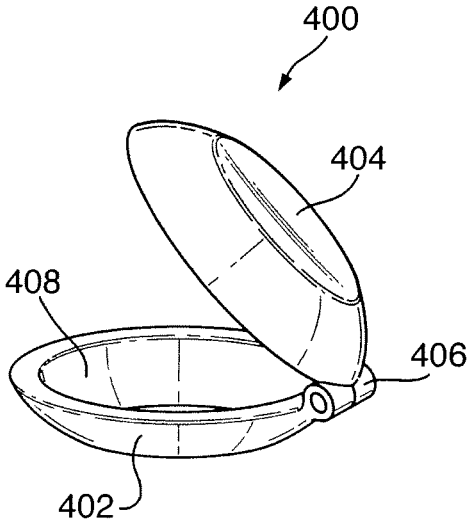
FIG. 11 is a perspective view of an embodiment of an applicator useful with the method illustrated in FIGS. 3A-5 in a first, pre-application state.
Figure 12:
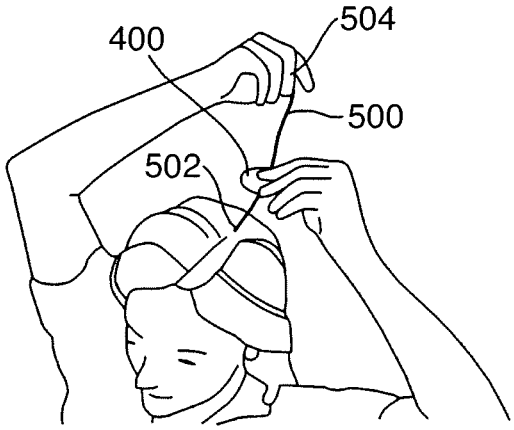
FIG. 12 is a perspective view of the applicator of FIG. 11 in a second, application state, in use.

Turning first to the applicator illustrated in FIGS. 11 and 12, the applicator 400 includes first and second sections 402, 404. The first and second sections 402, 404 are joined by a hinge 406, which may be a living hinge, for example. The hinge 406 permits the first and second sections 402, 404 to be moved between a first state in which the sections 402, 404 are spaced from each other and a second state in which the sections 402, 404 are disposed in close proximity to each other (see FIG. 12). At least the first section 402 has a space or depression 408 formed therein to receive an amount of the highlighting product disposed therein.

With reference then to FIG. 12, the operation of the hinged applicator 400 may be discussed. With the applicator 400 in the first state (sections 402, 404 spaced from each other), an amount of highlighting product is deposited in the applicator 400. The applicator 400 may be moved to the second state (sections 402, 404 in close proximity to each other). The applicator 400 is then returned to the first state, and a hair strand 500 disposed between the sections 402, 404, preferably near the base or root 502 of the strand 500. The applicator 400 is then moved to the second state such that the strand 500 is disposed between the first and second sections 402, 404. The applicator 400 is then moved along the strand 500 from the root 502 to a free end 504, thereby applying the product along the hair strand.

Figure 13A:
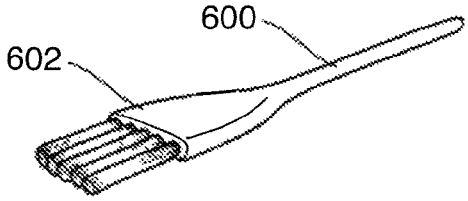
FIGS. 13A and 13B are perspective views of embodiments of a brush-type applicator.
Figure 13B:
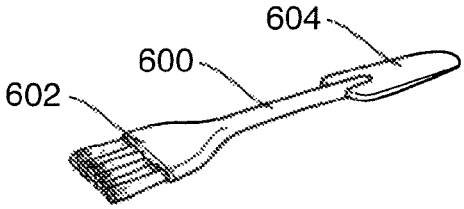
Figure 14A:
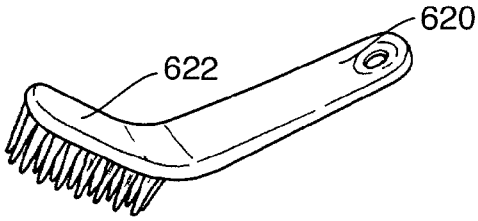
FIGS. 14A-14D are perspective views of embodiments of a comb-type applicator.
Figure 14B:
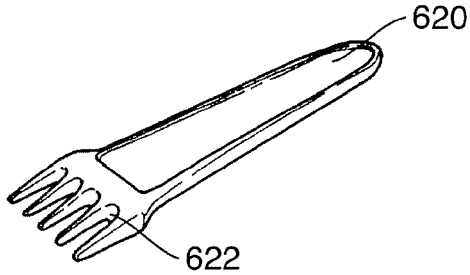
Figure 14C:
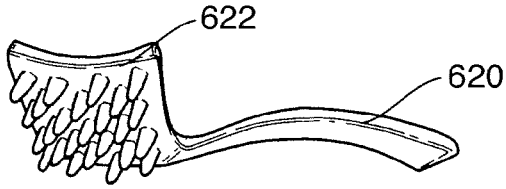
Figure 14D:
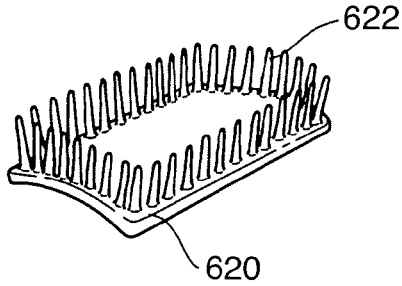

The brush-type applicators or brushes of FIGS. 13A and 13B include a graspable section 600 and an applicator section 602, generally disposed at opposite ends of the applicator. In certain embodiments, a stir 604 may be formed on the applicator to be used to mix the highlighting product. The applicator section 602 includes a plurality of bristles that are used to apply an amount of the highlighter product to the hair strand. Application is performed by running the applicator along the length of the strand from the root to the free ends. If the brush becomes void of product, it can be placed back into the product and then contacted again with the hair.

The comb-type applicators or combs of FIGS. 14A-14D may include a graspable section 620 and an applicator section 622, generally disposed at opposite ends or on opposite sides of the applicator. Like the brushes, certain embodiments may include a stir, although no such embodiment is illustrated. Typically, in distinction to the brushes of FIGS. 13A and 13B, the combs include a plurality of teeth or times. Application may also be performed by running the applicator along the length of the strand from the root to the free ends. If the comb becomes void of product, it can be placed back into the product and then contacted again with the hair.

The wand-type applicators or wands of FIGS. 15A and 15B include a graspable section 640 and an applicator section 642, generally disposed at opposite ends of the applicator. As illustrated, certain embodiments may include a stir 644. Like the brushes of 13A and 13B the wands include a plurality of bristles or protrusions, although these bristles or protrusions may be disposed in a series of discs arranged along a common axis. Here as well, application may be performed by running the applicator along the length of the strand from the root to the free ends. If the wand becomes void of product, it can be placed back into the product and then contacted again with the hair.

For purposes of sale and/or use, a system 700 as illustrated in FIG. 16 may be assembled including an applicator 702, a supply of hair strand effect (e.g., highlighting) product 704, and a hair instruction guide 706. As mentioned previously, the hair instruction guide 706 may include an illustration of at least one type of hair strand effect and a hair strand sizer as a single unit, or the guide may include the illustration and the hair strand sizer as separate units. According to certain embodiments, the system 700 may be assembled by the user after obtaining the applicator 702, the product 704 and guide 706 from different sources. According to other embodiments. the individual items 702, 704, 706 may be assembled as a kit through the use of packaging 708 that collects the items 702, 704, 706 together. As to the kit option, it may be that the applicator 702 and the product 704 or the applicator 702 and guide 706 are packaged and sold as a kit, with the third element packaged or sold separately. For example, the guide 706 may be obtained separate from the applicator 702 and the product 704, for example, from a point-of-purchase display, as part of an advertisement or over the Internet.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of imparting highlighting effects to hair comprising the steps of:

(a) planning the location of a plurality of hair strands from a whole head of hair, each hair strand having a width; the one or more hair strands are to be highlighted; the planning resulting in a planned hair strand selection;

(b) identifying hair strands to which to apply a hair strand effect product independently and individually, the hair strands associated with an illustration of at least one type of hair strand effects and one of a plurality of hair styles associated with each of the at least one type of hair strand effects; and using a hair strand sizer located on an edge of an instruction guide to separate the planned hair strand selection from the hair of the whole head; the hair strand sizer comprising sides being separated by a width corresponding to the width of the planned hair strand selection; the step resulting in an identified hair strand selection;

(c) securing temporarily to the identified hair strand selection the hair strand sizer to maintain the separation of the identified hair strand selection from the hair of the whole head; the step resulting in a secured hair strand selection;

(d) repeating the steps (b) and (c) one or more times with a different hair strand sizer for each secured hair strand selection, such that a plurality of hair strands are secured; and (e) applying a highlighting composition to each secured hair strand selection; wherein the highlighting composition is not applied to the hair of the whole head.

2. The method of claim 1 wherein the method further comprises the step of: waiting a predetermined length of time and then removing the highlighting composition from the secured hair strand selection.

3. The method according to claim 1, further comprising:

waiting a predetermined length of time; and removing the product from each of the plurality of hair strands.

4. The method according to claim 1, wherein said hair strand effect product is selected from the group consisting of hair highlighting products, hair dyeing products, hair styling products, hair perming products and combination thereof.

5. The method according to claim 1, wherein identifying the hair strands to which to apply the product comprises identifying a location of each of the hair strands about a head of a user.

6. The method according to claim 1, wherein identifying the plurality of hair strands to which to apply the product comprises selecting each of the plurality of hair strands to which to apply the product independently and individually.

7. The method according to claim 6, wherein identifying the plurality of hair strands to which to apply the product comprises selecting each of the plurality of hair strands to which to apply the product independent and individually without use of a cap applied to the head of the user, the cap having a plurality of predetermined hair strand locations.

8. The method of claim 1, wherein applying the product to the strand comprises:

depositing an amount of the product in an applicator having first and second sections;

disposing the strand between the first and second sections of the applicator;

moving the first and second sections towards each other to close the applicator with the strand disposed between the first and second sections; and moving the closed applicator along the strand.

9. The method of claim 8, wherein the applicator comprises a hinge joining the first and second sections.

10. The method of claim 8, comprising:

moving the closed applicator along the strand from a root end to a free end.

11. The method according to claim 8, wherein at least one of the first and second sections of the applicator has a receptacle formed therein to receive an amount of the hair strand product, and the first and second sections are moveable between a first state wherein opposing surfaces of the first and second sections are spaced, and a second state wherein opposing surfaces of the first and second sections are in close proximity to each other.

12. The method of claim 1, wherein the instruction guide is located on the packaging used in conjunction with a highlighting kit.

13. The method of claim 1, wherein the instruction guide is separate from the packaging used in conjunction with a highlighting kit.

* * * * *